United States Patent [19]

Gorjat

[11] Patent Number: 4,866,842

[45] Date of Patent: Sep. 19, 1989

[54] METHOD OF MAKING A SHIELDED CABLE HARNESS

[75] Inventor: Jean Gorjat, Harrisburg, Pa.

[73] Assignee: AMP Incorporated, Harrisburg, Pa.

[21] Appl. No.: 252,334

[22] Filed: Sep. 30, 1988

[51] Int. Cl.[4] ..... H01R 43/00

[52] U.S. Cl. ..... 29/857; 29/828; 174/36

[58] Field of Search ..... 174/36, 115, 34; 29/868, 828, 857

[56] References Cited

U.S. PATENT DOCUMENTS

| | | | |
|---|---|---|---|
| 2,109,334 | 2/1938 | Kaden et al. | 174/36 X |
| 3,032,604 | 5/1962 | Timmons | 174/36 X |
| 3,609,216 | 9/1971 | Copp | 174/36 X |
| 3,829,603 | 8/1974 | Hansen et al. | 174/36 X |
| 3,914,531 | 10/1975 | Zell et al. . | |
| 4,373,261 | 2/1983 | Long, Jr. . | |
| 4,428,114 | 1/1984 | Teagno . | |
| 4,493,147 | 1/1985 | Bakermans . | |
| 4,644,098 | 2/1988 | Norris et al. | 174/115 |
| 4,719,319 | 1/1988 | Tighe, Jr. . | |

FOREIGN PATENT DOCUMENTS

| | | | |
|---|---|---|---|
| 937851 | 9/1963 | United Kingdom | 174/36 |

*Primary Examiner*—Howard N. Goldberg
*Assistant Examiner*—Carl J. Arbes
*Attorney, Agent, or Firm*—William B. Noll

[57] ABSTRACT

The present invention is directed to a method of making a shielded cable harness having a plurality of discrete wires whose opposite ends are terminated to a pair of electrical connector housings, and a drain wire terminated to at least one of said housings. In a preferred embodiment, the method includes the steps of manufacturing a harness composed of a plurality of discrete wires of predetermined length arranged generally in parallel fashion between a pair of housings, with one having a drain wire. Such harness, in this preliminary state, may consist of plural discrete wires with individual leads at the respective wire ends for insertion into appropriate cavities of a connector housing, or the discrete wires may be directly inserted into a housing such as by an insulation displacement termination. In either case, the discrete wires, typically arrayed in parallel fashion, are twisted in a first direction to spirally arrange such wires, followed by twisting the drain wire in an opposite direction around said spirally arranged discrete wires. The method is completed by placing a jacket of insulative material about said twisted wires, where said jacket has been provided with an inner metallic layer for contact with said drain wire, and applying an insulative sleeve where said discrete wires project from said jacket. In its most preferred embodiment, said jacket comprises an elongaed "C" shaped member having a laminated metallic layer on the inside thereof.

7 Claims, 2 Drawing Sheets

METHOD OF MAKING A SHIELDED CABLE HARNESS

The present invention is directed to a method of making a shielded cable harness having a plurality of discrete wires whose opposite ends are terminated to a pair of electrical connector housings, and a drain wire terminated to only one of said housings.

Electrical harnesses have been manufactured for years and are used extensively in the automotive, appliance, electronic, and telecommunication industries. They may include a number of conductors, i.e. discrete wires or ribbon cable, and can be quite long depending on use. Typically, such harnesses, particularly multi-conductor, complex harnesses, are produced on automated apparatus, which can include electrical testing capabilities.

For less complex harnesses, which are relatively short and require a limited number of conductors, present automated apparatus may not be fully adequate where further operations are required, such as providing a shield about the conductors. Presently, a harness of this type is ordinarily made by using previously prepared shielded cable, cutting the required length for the harness from the cable, stripping the outer jacket and shield from the cable ends, and then installing the connectors on the cable ends. If crimped connections are required, rather than IDC's, the individual conductors must be stripped and the stripped ends crimped onto terminals. Thereafter, the terminals are inserted into the housings. This process is labor intensive and subject to high scrap losses because of the possibility of damaging the conductors when the jacket is removed from the cable ends.

The present invention represents a unique approach for manufacturing a shielded cable harness by utilizing available automated apparatus, such as a cable making machine or lead making machine, to produce the harness, followed by placing an appropriate shield thereabout. The method of this invention will become more apparent in the description which follows.

SUMMARY OF THE INVENTION

This invention relates to a method of making a shielded cable harness having a plurality of discrete wires whose opposite ends are terminated to a pair of electrical connector housings, and a drain wire terminated to at least one of said housings. The method comprises the steps of manufacturing a harness composed of a plurality of discrete wires of predetermined length arranged generally in parallel fashion between a pair of housings, where one of said housings includes a drain wire having a length less than said predetermined length. The method continues by twisting the discrete wires in a first direction to spirally arrange such wires, followed by twisting said drain wire in an opposite direction around said spirally arranged discrete wires. Finally, a jacket of insulative material is placed about the twisted wires, where said jacket has been provided with an inner metallic layer for contact with said drain wire. In a preferred embodiment, the jacket shield is an extruded "C" shaped member, having a laminated, metallic inner layer, which may be placed about the twisted wires and joined along the seam. Alternatively, the inner metallic layer may consist of a metallic foil wrapper thereabout, followed by an preferred to provide the harness with insulative sleeves when said discrete wires project from said jacket.

DETAILED DESCRIPTION OF PREFERRED EMBODIMENT

Figure 1:
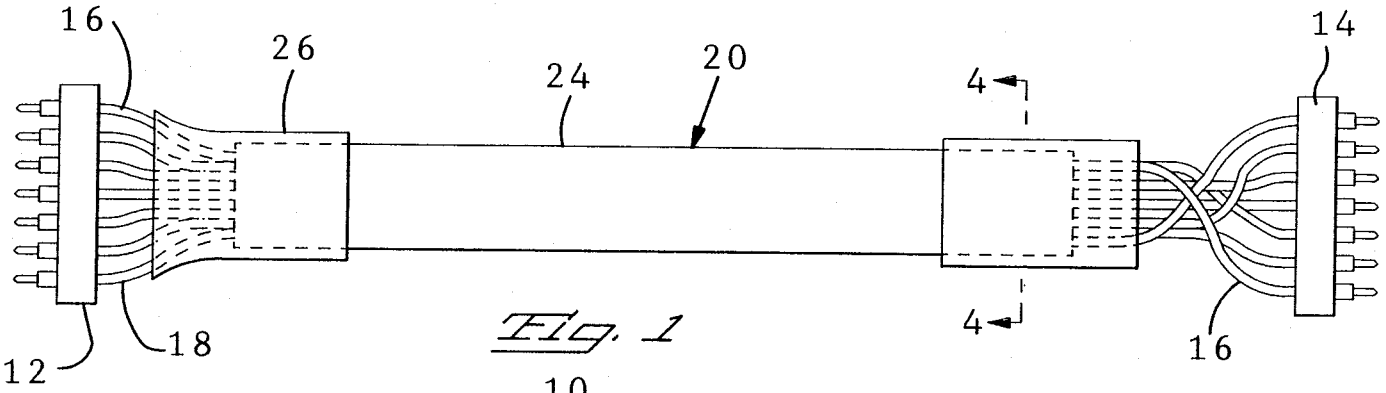
FIG. 1 is a plan view of a shielded cable harness produced by the method of this invention.

This invention relates to the production of a shielded cable harness having a plurality of discrete wires terminated at their respective ends to a pair of electrical connector housings, and a drain wire terminated to only one of said housings.

The manufacture of harness assemblies is a practice that has been followed for a number of years. Further, such harness assemblies have been manufactured using plural discrete wires or multi-conductor cable, where the wire or conductor ends are provided with insulation displacement contacts, or crimped terminals. The present invention utilizes discrete wires.

Automatic lead making machines are commonly known to the art which are capable of producing, from a coil or other endless source of wire, leads of a given length having insulation piercing type terminals crimped onto one or both ends thereof. These machines are fully automatic in the sense that the wire is automatically fed and cut to the desired length, and the terminals are automatically fed and crimped onto the wire. With this type of termination, stripping of the insulation about the conductor is not required. Such procedure is taught in U.S. Pat. No. 2,694,808.

Automatic lead making machines are now commonplace by which the wire cutting and stripping operations are performed automatically, following by crimping a terminal to such cut and stripped wire ends, U.S. Pat. No. 3,086,282. From such automatically produced discrete leads, a harness may be fabricated by inserting the leads thereof into electrical connector housings.

There is also known apparatus for producing electrical harnesses in which the connectors traverse an operating path through successive zones or stations. U.S. Pat. No. 4,428,114 teaches a method and apparatus for making modular electrical harnesses, which include feeding first and second connector parts of a pair aligned in end-to-end relation to first and second spaced terminating stations of an operating zone. A leading end of a wire extending from a wire supply is terminated in a preselected terminal of the first connector part at the first terminating station. Thereafter, wire is fed from the wire supply to form a trailing loop of preselected length, followed by indexing the trailing end of the wire to the second terminating station into alignment with a preselected terminal of the second connector part. The trailing end of the wire is terminated in the preselected terminal of the second connector part and the trailing end severed so that the wire loop extends between the terminals in a plane parallel to the terminal rows. The operation is continued by feeding the first and second connector parts in end-to-end relation through successive similar operating zones at which the said steps are repeated so that all the preselected terminals of the first connector part are progressively connected to preselected terminals of the second connector parts by respective wire loops. The resulting product is an electrical harness consisting of a pair of electrical connectors having a plurality of discrete wires terminated to and arranged generally in a parallel relationship between said connectors. A simple modification may be made to such operation to provide a bare drain wire terminated to only one of said connectors.

Figure 2:
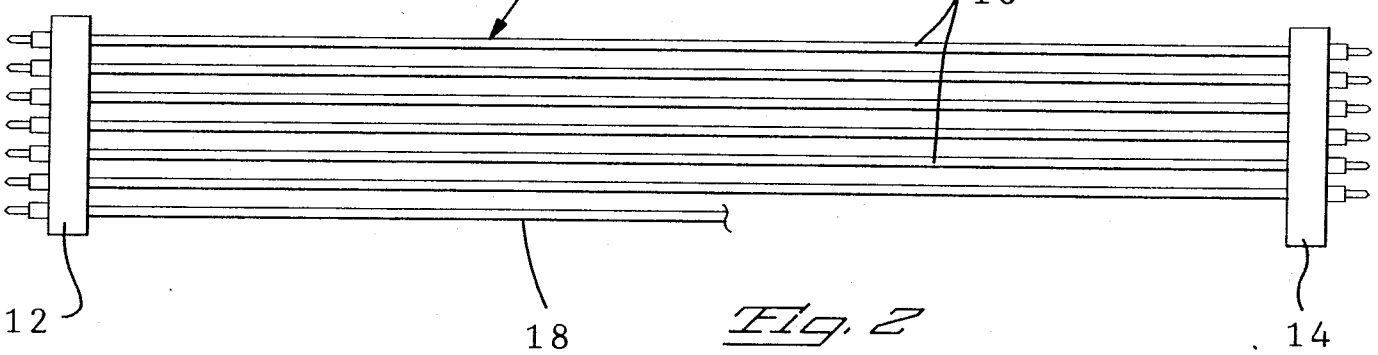
FIG. 2 is a plan view of a harness assembly suitable as a starting product for practicing the method of this invention.

Thus, the present invention, by utilizing as its starting product, a ready made harness 10 as illustrated in FIG. 2, can take advantage of present day automation. As shown therein, such harness comprises a pair of connector housings 12,14 and a plurality of discrete wires 16 terminated at their respective ends to such housings. Additionally, an insulation-free drain wire 18 is included, the function of which will be more apparent hereinafter.

Figure 3:
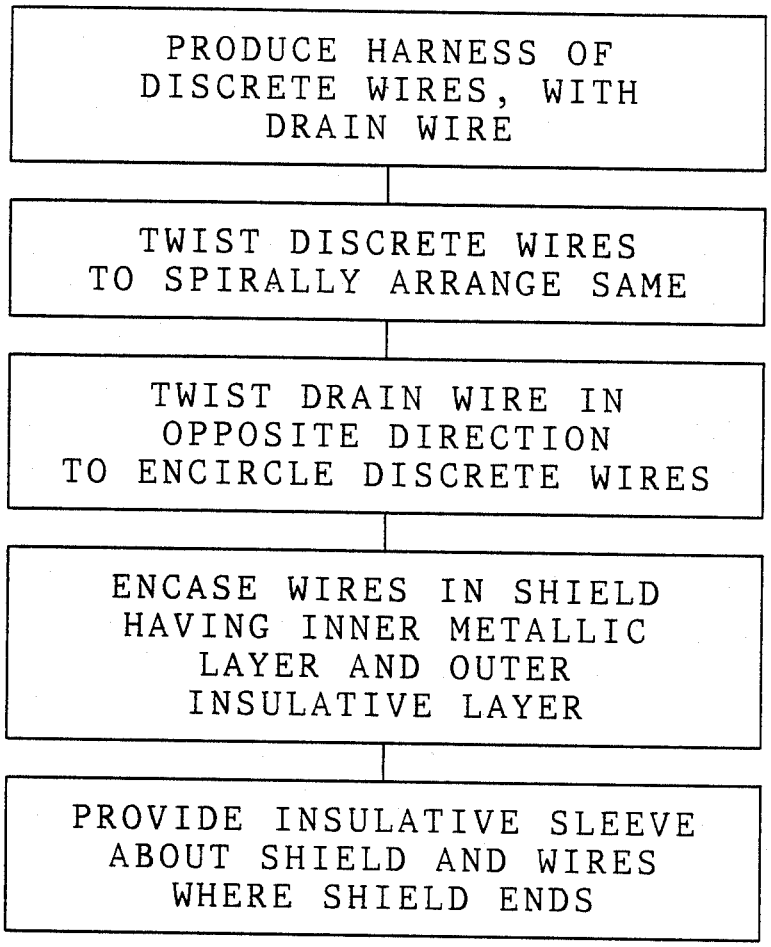
FIG. 3 is a block diagram of the method hereof to transform the harness assembly of FIG. 2 into the shielded cable harness of FIG. 1.

FIG. 3 is a block diagram setting forth the several steps of the present invention. As indicated above, the first step is the production of an electrical harness, such as shown in FIG. 2. Thereafter, the discrete wires 16 are twisted, such as rotating housing 14, to spirally arrange such wires. By this arrangement, the drain wire 18 is unaffected whereby it can now be wrapped about the spirally arranged wires 16 to be on the outside thereof. Preferably, the wrapping or direction of twisting of drain wire 18 should be opposite to that of the discrete wires 16. As an alternative, the remote end of drain wire 18, after wrapping, may be terminated to the free housing.

Figure 4:
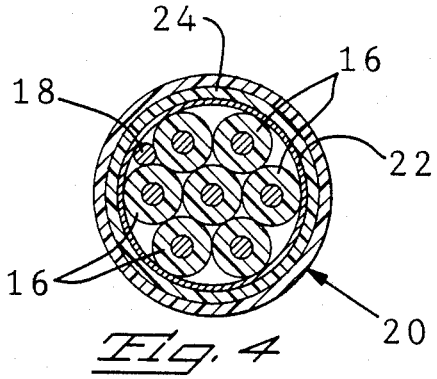
FIG. 4 is an enlarged sectional view taken along line 4—4 in Figure 1.

With the wires relatively tightly arranged, a shield or jacket 20, as shown in FIG. 1, may be provided thereabout. The shield 20, as more particularly shown in section in FIG. 4, comprises a first or inner layer 22 of a conductive material, such as aluminum or copper foil, which may be wrapped about the twisted wires, or it may comprise a layer laminated to the second or outer insulative layer 24. In any case, by virtue of the fact that the drain wire 18 is bare and wound about the discrete wires !6, such drain wire is in conductive or grounding relationship with regard to the metallic inner layer 22.

The outer layer 24, preferably formed of a flexible insulative material such as PVC, may be wound about the inner layer covered wires, or it may be extruded, having a "C" shaped configuration to encase the twisted wires. The elongated and extruded member may be closed and the seam thereof joined in a suitable fashion well known in the art. For example, such member may be provided with flanges, i.e. "Ω" shaped, with the respective flanges joined such as by plastic welding.

Finally, since the shielding is typically short of the connector housings 12,14, a heat shrinkable sleeve 26 may be placed about the shield 24 where the wires 16 exits the shield, see FIG. 3.

I claim:

1. A method of making a shielded cable harness having a plurality of discrete wires whose opposite ends are terminated to a pair of electrical connector housings, and a drain wire terminated to at least one of said housings, comprising the steps of manufacturing a harness composed of a plurality of discrete wires of predetermined length arranged generally in parallel fashion between a pair of housings, where one of said housings includes a drain wire, twisting said discrete wires in a first direction to spirally arrange such wires, twisting said drain wire in an opposite direction around said spirally arranged discrete wires, placing a jacket of insulative material about said twisted wires, where said jacket has been provided with an inner metallic layer for contact with said drain wire, and completing said harness by applying an insulative sleeve where said discrete wires project from said jacket.

2. The method of manufacturing a shielded cable harness according to claim 1 wherein said inner metallic layer is formed by wrapping metallic foil about said twisted discrete wires.

3. The method of manufacturing a shielded cable harness according to claim 2 wherein said jacket is formed by wrapping insulative tape over said metallic foil.

4. The method of manufacturing a shielded cable harness according to claim 2 wherein said jacket is formed by heat shrinkable tubing placed over said metallic foil.

5. The method of manufacturing a shielded cable harness according to claim 1 wherein said jacket comprises an elongated "C" shaped member placed over said discrete wires, where said member on the inside thereof has been provided with a laminated metallic layer.

6. The method of manufacturing a shielded cable harness according to claim 5, including the further step of longitudinally joining the edges of said elongated member to seal the underlying discrete wires.

7. The method of manufacturing a shielded cable harness according to claim 1 wherein the free end of said drain wire, after wrapping about said discrete wires, is terminated to said second housing.

* * * * *